US011837070B2

(12) United States Patent
Kim

(10) Patent No.: US 11,837,070 B2
(45) Date of Patent: Dec. 5, 2023

(54) ENVIRONMENTAL AND CONTEXTUAL CUSTOM-BUILT AI-BASED, INTERLAYER NOISE ABATEMENT APPARATUS AND METHOD OF THE SAME

(71) Applicant: Hyun Been Kim, Daejeon (KR)

(72) Inventor: Hyun Been Kim, Daejeon (KR)

( * ) Notice: Subject to any disclaimer, the term of this patent is extended or adjusted under 35 U.S.C. 154(b) by 16 days.

(21) Appl. No.: 17/930,687

(22) Filed: Sep. 8, 2022

(65) Prior Publication Data

US 2023/0073316 A1 Mar. 9, 2023

(30) Foreign Application Priority Data

Sep. 8, 2021 (KR) ..... 10-2021-0119827

(51) Int. Cl.

| | |
|---|---|
| ***G08B 21/18*** | (2006.01) |
| ***E04F 15/20*** | (2006.01) |
| ***G08B 5/22*** | (2006.01) |
| ***G08B 3/10*** | (2006.01) |

(52) U.S. Cl.

CPC ..... *G08B 21/182* (2013.01); *E04F 15/203* (2013.01); *G08B 3/1008* (2013.01); *G08B 5/222* (2013.01); *E04F 2290/043* (2013.01)

(58) Field of Classification Search

CPC .... G08B 21/182; G08B 3/1008; G08B 5/222; E04F 15/203; E04F 2290/043; E04F 2290/041

See application file for complete search history.

(56) References Cited

U.S. PATENT DOCUMENTS

| | | | | |
|---|---|---|---|---|
| 6,483,926 | B1 * | 11/2002 | Yamashita | G10K 11/17879 381/71.7 |
| 2020/0189242 | A1 * | 6/2020 | Cai | B32B 13/042 |
| 2021/0201391 | A1 * | 7/2021 | Metev | G06V 40/20 |
| 2021/0209918 | A1 * | 7/2021 | Birnkrant | G08B 17/107 |
| 2021/0381861 | A1 * | 12/2021 | Brown | G05D 27/02 |
| 2022/0082721 | A1 * | 3/2022 | Holifield | G01V 3/081 |
| 2022/0130365 | A1 * | 4/2022 | Park | G10K 11/17827 |
| 2022/0300789 | A1 * | 9/2022 | DeLaRosa | G06N 3/048 |
| 2022/0309618 | A1 * | 9/2022 | DeLaRosa | G06T 5/50 |
| 2022/0314577 | A1 * | 10/2022 | Van Der Eem | E04F 15/203 |

FOREIGN PATENT DOCUMENTS

KR 20160144205 A 12/2016

* cited by examiner

*Primary Examiner* — Ojiako K Nwugo
(74) *Attorney, Agent, or Firm* — McCoy Russell LLP

(57) ABSTRACT

Provided is technology to reduce interlayer noise occurring in a multi-story house such as an apartment, and more particularly, an environmental and contextual custom-built artificial intelligence (AI) based, interlayer noise abatement apparatus that defines a standard of interlayer noise based on a user environment or a user-specified context, allows an interlayer noise maker to recognize when the noise exceeding the above standard occurs and allows the interlayer noise maker to voluntarily reduce the interlayer noise, and a method of the same.

12 Claims, 6 Drawing Sheets

ENVIRONMENTAL AND CONTEXTUAL CUSTOM-BUILT AI-BASED, INTERLAYER NOISE ABATEMENT APPARATUS AND METHOD OF THE SAME

CROSS-REFERENCE TO RELATED APPLICATION

The present application claims priority to Korean Patent Application No. 10-2021-0119827, filed on Sep. 8, 2021. The entire contents of the above-listed application are hereby incorporated by reference for all purposes.

TECHNICAL FIELD

The following disclosure relates to technology to reduce interlayer noise occurring in a multi-story house such as an apartment. More particularly, the following disclosure relates to an environmental and contextual custom-built artificial intelligence (AI) based, interlayer noise abatement apparatus that defines a standard of interlayer noise based on a user environment or a user-specified context, allows an interlayer noise maker to recognize when the noise exceeding the above standard occurs and allows the interlayer noise maker to voluntarily reduce the interlayer noise, and a method of the same.

BACKGROUND

Interlayer noise may refer to noise pollution mainly occurring in a multihouse such as a multiplex house or an apartment, and may be, for example, noise transmitted through an upstairs floor surface to a downstairs ceiling surface.

The interlayer noise may be a generic term for sound of toilet water, floor impact sound, piano sound, audio sound, dialogue sound and television (TV) sound. The floor impact sound among the interlayer noise may be classified into light-weight impact sound (floor impact sound caused by a relatively light and hard impact, and less than 58 dB by a legal standard) and heavy-weight impact sound (floor impact sound caused by heavy and soft impact, and less than 50 dB by the legal standard).

The interlayer noise problem began to emerge as the multihouse such as the apartment became popular currently from a lifestyle mainly centered on a detached house in the past, and conflicts caused by the interlayer noise frequently occur due to a characteristic of the multihouse where a plurality of households live with a single wall and floor therebetween.

In particular, among the interlayer noise, the floor impact sound (or solid transmission sound) occurring by a direct impact on a concrete surface may be easily transmitted to an adjacent household. The floor impact sound may mainly be the sound of children running upstairs, the sound of dragging or dropping an object, or the like, and the interlayer noise may adversely affect mental and physical health like another noise pollution. Due to this reason, the floor impact sound has long been raised as a social problem such as many problems and complaints between neighboring residents.

Therefore, in order to prevent the interlayer noise, which has become such a social problem, Korean Patent No. 10-1740046, which is the prior art, discloses the following. Developed and used is an inter-floor noise prevention material for a multihouse that includes: a gel sheet made of a gel material and seated on a floor surface of an inter-floor slab to block the floor impact sound belonging to vibration; a rubber sheet made of a rubber material and stacked on an upper portion of the gel sheet to block the heavy-weight impact sound belonging to a low frequency; a foam sheet made of a foam material and stacked on an upper portion of the rubber sheet to block a light-weight impact sound belonging to a high frequency; and an adhesive sheet each stacked between the foam sheet, the rubber sheet and the gel sheet.

The technology for preventing the interlayer noise as described above aims to reduce or abate the noise that is occurring rather than block a cause of the noise. Therefore, there is a limit to reducing the noise, and the noise may continuously occur as long as an interlayer noise maker does not recognize this situation. In addition, the noise standard may be raised or lower depending on an environment or a context. It is difficult to reflect this standard, and it is thus difficult to fundamentally solve the interlayer noise.

SUMMARY

Embodiments of the present disclosure are directed to providing an environmental and contextual custom-built artificial intelligence (AI) based, interlayer noise abatement apparatus that monitors noise occurring in each of the multiplex houses by using a noise detection device and provides its feedback to each house, and allows a noise-making household to recognize the noise, thereby fundamentally reducing noise occurrence, and a method of the same.

Embodiments of the present disclosure are directed to providing an environmental and contextual custom-built artificial intelligence (AI) based, interlayer noise abatement apparatus that particularly allows a noise standard to be flexibly changed based on each customized condition for an environment or a context, and thus allows the noise-making household to flexibly use this standard when the noise standard is lower or higher, thereby increasing satisfaction of an interlayer noise victim due to reduced noise and also guaranteeing privacy of the interlayer noise maker, and a method of the same.

Embodiments of the present disclosure are directed to providing an environmental and contextual custom-built artificial intelligence (AI) based, interlayer noise abatement apparatus that includes a noise reduction device which may reduce the noise that is occurring and be operated only when the noise exceeds the above-mentioned noise standard, thereby improving the durability and operating efficiency of the noise reduction device, and a method of the same.

Embodiments of the present disclosure are directed to providing an environmental and contextual custom-built artificial intelligence (AI) based, interlayer noise abatement apparatus that allows a noise-making home appliance to include a power control device and thus be operated only during a specific time zone or operated based on consent of multiplex house residents when a user wishes to use the home appliance at a specific time, and a method of the same.

Embodiments of the present disclosure are directed to providing an environmental and contextual custom-built artificial intelligence (AI) based, interlayer noise abatement apparatus that makes the interlayer noise only when the multiplex house residents permit the noise that occurs, thereby minimizing conflicts between the households caused by the interlayer noise, and a method of the same.

Embodiments of the present disclosure are directed to providing an environmental and contextual custom-built artificial intelligence (AI) based, interlayer noise abatement apparatus that particularly monitors a main usage time of a noise-making home appliance for each household and converts the same into big data, analyzes a specific usage pattern for each household through learning such as deep learning, and notifies a neighboring household in advance based thereon, and a method of the same.

In one general aspect, an environmental and contextual custom-built artificial intelligence (AI) based, interlayer noise abatement apparatus, the apparatus includes: a plurality of noise detection sensors positioned in each household to measure noise occurring in each household residing in a multiplex house; a noise display positioned in each household and displaying noise information detected by the noise detection sensor for each household to recognize the noise; and a controller controlling the noise information detected by the noise detection sensor to be received and controlling the noise information to be transmitted to the noise display only when the noise exceeds a certain standard value for the noise information to be displayed through the noise display.

In addition, the noise abatement apparatus may further include a noise reduction device reducing the noise when the noise is detected by the noise detection sensor.

In addition, the controller may control the noise information detected by the noise detection sensor to be received, and control the noise reduction device to reduce the noise only when the noise exceeds the certain standard value.

In addition, the noise reduction device may include a first noise reduction device installed on the bottom of a floor surface of an upstairs household among the respective households to reduce noise occurring in the upstairs household by using contact reduction vibration, and a second noise reduction device installed on the top of a ceiling surface of a downstairs household among the respective households to reduce the noise occurring in the upstairs household by using non-contact reduction vibration.

In addition, the first noise reduction device may reduce heavy-weight noise or direct transmission noise of the upstairs household, and the second noise reduction device may reduce light-weight noise or indirect transmission noise of the upstairs household.

In addition, the noise display may induce a corresponding household to reduce the noise by displaying the corresponding household in a specific color indicating a caution when the noise exceeds a first standard value which is the certain standard value, and forcibly induce the corresponding household to reduce the noise by displaying the corresponding household in another specific color indicating a warning when the noise exceeds a second standard value which is higher by a certain width than the first standard value.

In addition, the noise abatement apparatus may further include a noise standard setter that delivers noise standard information to the controller for a noise standard to be set based on a parameter for each environment or context.

In addition, the noise standard setter may change the noise standard based on any one or more selected from a time zone, weather, and the age, gender or noise pattern of the household.

In addition, the controller may control the noise information detected by the noise detection sensor to be received, and control the noise to be reduced by the noise reduction device only when the noise exceeds the certain standard value.

In addition, the noise display may include a main display displaying noise intensity for each household, a sub display separately displaying the noise intensity of a household in which the noise display is installed, and a sensitivity manipulator allowing a corresponding household to manually select noise sensitivity.

In addition, the noise display may be applied to an intercom installed in each household, a separate display device or a television (TV) by assigning a channel of a cable TV.

In addition, when the warning for the corresponding household is displayed, the controller may allow the corresponding household to be alarmed through a speaker or by the announcement or phone call of a management office to forcibly induce the corresponding household to reduce the noise.

In another general aspect, an environmental and contextual custom-built artificial intelligence (AI) based, interlayer noise abatement method includes: an operation of setting a standard value in which the noise standard value is set based on an environment, a context, or a manual operation of noise sensitivity; an operation of obtaining noise information in which the noise information of each household is obtained by a noise detection sensor; an operation of determining whether intensity of the noise information of each household exceeds a first standard value; an operation of repeating the operation of the determining when the intensity of the noise information is equal to or less than the first standard value, and proceeding to a next operation when the intensity of the noise information exceeds the first standard value; an operation of determining whether the intensity of the noise information of each household exceeds a second standard value; and an operation of notifying a caution to a corresponding noise-making household when the intensity of the noise information is equal to or less than the second standard value, or notifying a warning to the corresponding noise-making household when the intensity of the noise information exceeds the second standard value.

Other features and aspects will be apparent from the following detailed description and the drawings.

DETAILED DESCRIPTION

Hereinafter, embodiments of the present disclosure are described in detail with reference to the accompanying drawings.

Figure 1:
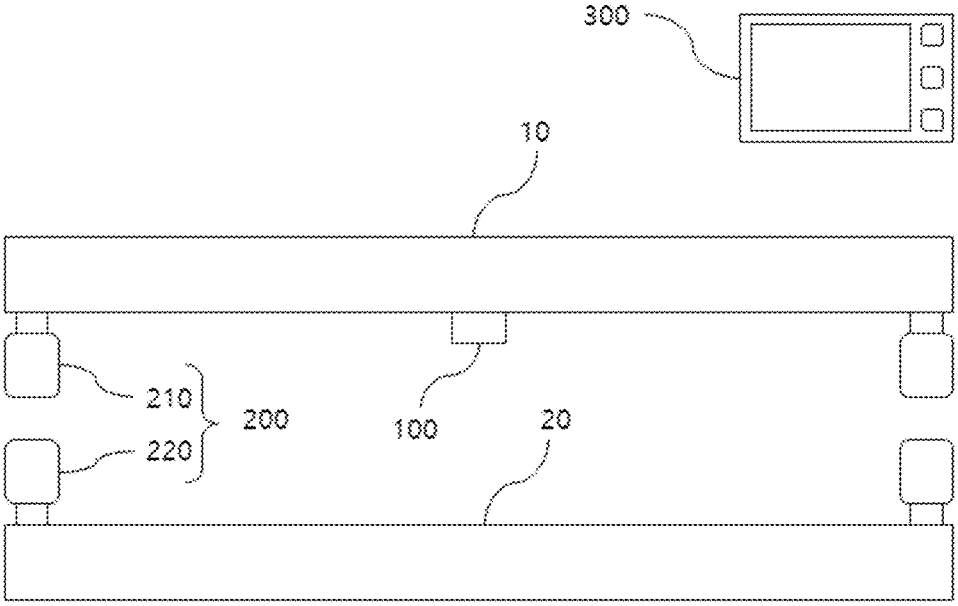
FIG. 1 is a schematic diagram of an environmental and contextual custom-built artificial intelligence (AI) based, interlayer noise abatement apparatus according to an embodiment of the present disclosure.

FIG. 1 shows a schematic diagram of an environmental and contextual custom-built artificial intelligence (AI) based, interlayer noise abatement apparatus 1000 of the present disclosure (hereinafter, 'noise abatement apparatus'). In addition, FIG. 2 is a block diagram showing a detailed configuration of the noise abatement apparatus 1000 and a binary noise abatement method using the same.

As shown in the drawings, the noise abatement apparatus 1000 may include a noise detection sensor 100, a noise reduction device 200 and a noise display 300.

The noise detection sensor 100 may be a device that detects a level of noise occurring in a neighboring household, and installed on the bottom of an upstairs floor surface 10. The noise detection sensor 100 may include a noise sensor for detecting sound and a vibration sensor for detecting vibration.

Figure 2:
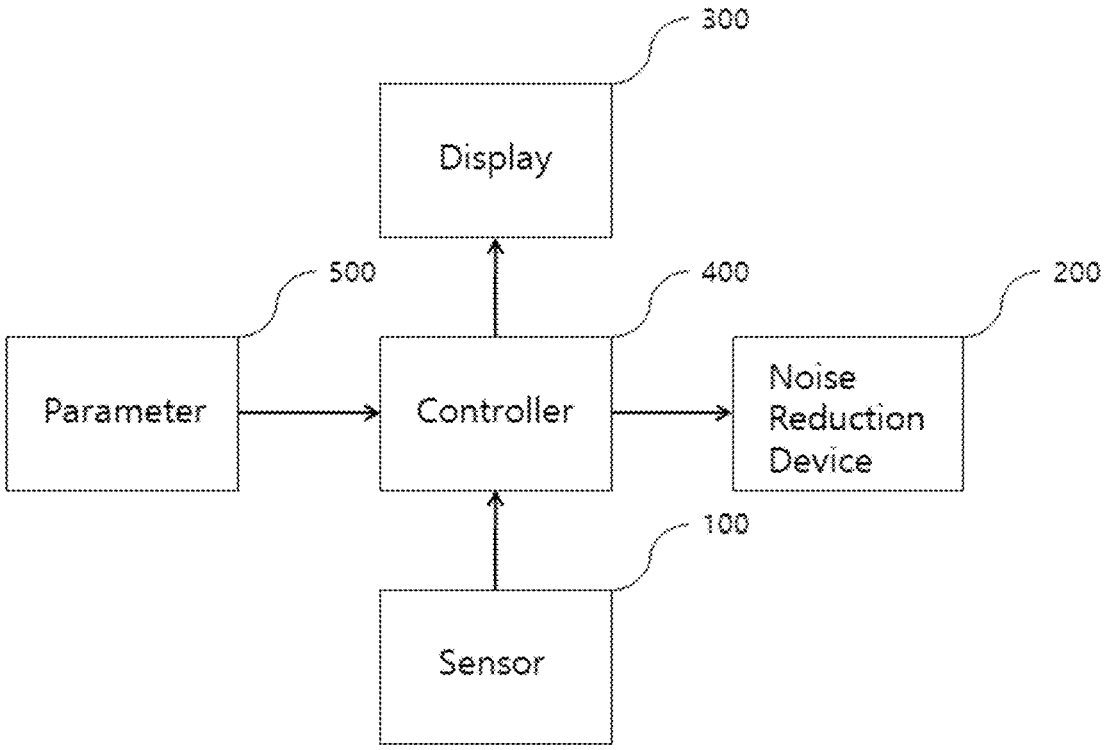
FIG. 2 is a block diagram showing a detailed configuration of the noise abatement apparatus and a binary noise abatement method using the same.

As shown in FIG. 2, the noise reduction device 200 may reduce the noise by generating reverse vibration with respect to the vibration detected by the noise detection sensor 100, and modulating a phase of an acoustic frequency with respect to the detected sound to generate an antiphase. The noise reduction device 200 may include a first noise reduction device 210 reducing direct impact noise, and a second noise reduction device 220 reducing indirect transmission noise. The direct impact noise may refer to the noise caused by the vibration occurring due to physical impact. For example, the direct impact noise may correspond to walking noise such as a sound of a footstep, a running noise, an impact sound such as hammer sound, or a sound of pulling furniture. The direct impact noise may be reduced by contact reduction vibration. Accordingly, the first noise reduction device 210 may be installed on the bottom of the upstairs floor surface 10 to directly intervene in the noise occurring in the neighboring household, thereby minimizing the noise transmitted to a corresponding household. The first noise reduction device 210 may be a vibrator for generating the vibration. The first noise reduction device 210 may reduce the noise or the vibration by generating the reverse vibration with respect to the noise or the vibration. Accordingly, the first noise reduction device 210 may allow excitation for the reverse vibration to be directly transmitted to the upstairs floor surface 10 in order to reduce the noise that physically occurs. Therefore, the first noise reduction device 210 may reduce the direct impact noise occurring on the upstairs floor surface 10.

In addition, the direct impact noise may be divided into low-frequency vibration noise such as hammer sound, heavy thumping sound, drum sound or the like, and high-frequency vibration noise such as a furniture pulling sound, a light footstep sound, a high note of a musical instrument, or the like. The low-frequency vibration noise may have a slow speed and a large force, and thus be offset by a large-capacity vibrator that may generate large vibration even though its reaction speed is slow. The high-frequency vibration noise may have a low force and a high speed, and may thus be offset by a reverse-vibration vibrator having a fast reaction speed.

On the other hand, the indirect transmission noise may be the noise transmitted through sound, and correspond to, for example, a sound of water, a high note of music from a piano or a speaker, everyday voice such as a conversation, or the like. The indirect transmission noise may be the noise caused by the sound rather than the physical vibration, and may thus be reduced by non-contact reduction vibration. To this end, the second noise reduction device 220 may be an acoustic phase modulator for reducing an acoustic phase of the noise. In more detail, the second noise reduction device 220 may detect the phase of a sound wave that occurs by using the noise detection sensor 100, and generate a wavelength of the antiphase to the phase, thereby reducing the noise. Therefore, the second noise reduction device 220 may include the phase modulator for receiving phase information of the sound wave detected by the noise detection sensor 100 and generating the wavelength of the antiphase of the sound wave.

Accordingly, the second noise reduction device 220 may be installed on the top of a downstairs ceiling surface 20 to indirectly intervene in the noise occurring in the neighboring household, thereby minimizing the noise transmitted to the corresponding household. FIG. 1 shows that the second noise reduction device 220 is installed on the top of the downstairs ceiling surface 20. However, the second noise reduction device 220 may be installed between a side wall of the neighboring household and a side wall of the corresponding household, or installed on an outer surface of the side wall of the corresponding household.

The second noise reduction device 220 may transmit a signal of the antiphase according to a signal of the sound wave of the neighboring household to the upstairs floor surface 10 or the side wall of the neighboring household in a non-contact manner. Accordingly, the second noise reduction device 220 may reduce the indirect transmission noise occurring in the upstairs floor surface 10 or the sidewall.

It is possible to reduce the interlayer noise by using the noise reduction device 200 as above when the acoustic noise or the vibration noise occurs in the neighboring household.

The noise display 300 may allow intensity of the noise or the vibration that is difficult to be recognized by the noise-making household to be recognized by the corresponding household. In detail, the intensity of the noise or the vibration may be displayed to the corresponding household through a display device positioned in the corresponding household. Therefore, the intensity of the noise or vibration occurring in the noise-making household may be intuitively recognized by the noise-causing household, such that the noise-causing household may be induced to voluntarily reduce the noise or vibration. There is a limit to reducing the transmission of the noise or the vibration that already occurs to the neighboring households. However, it is possible to induce the noise-causing household in which the noise or the vibration occurs to fundamentally prevent the occurrence of the noise or the vibration. Accordingly, the noise abatement apparatus may not only reduce the interlayer noise but also prevent or block the interlayer noise.

Figure 3:
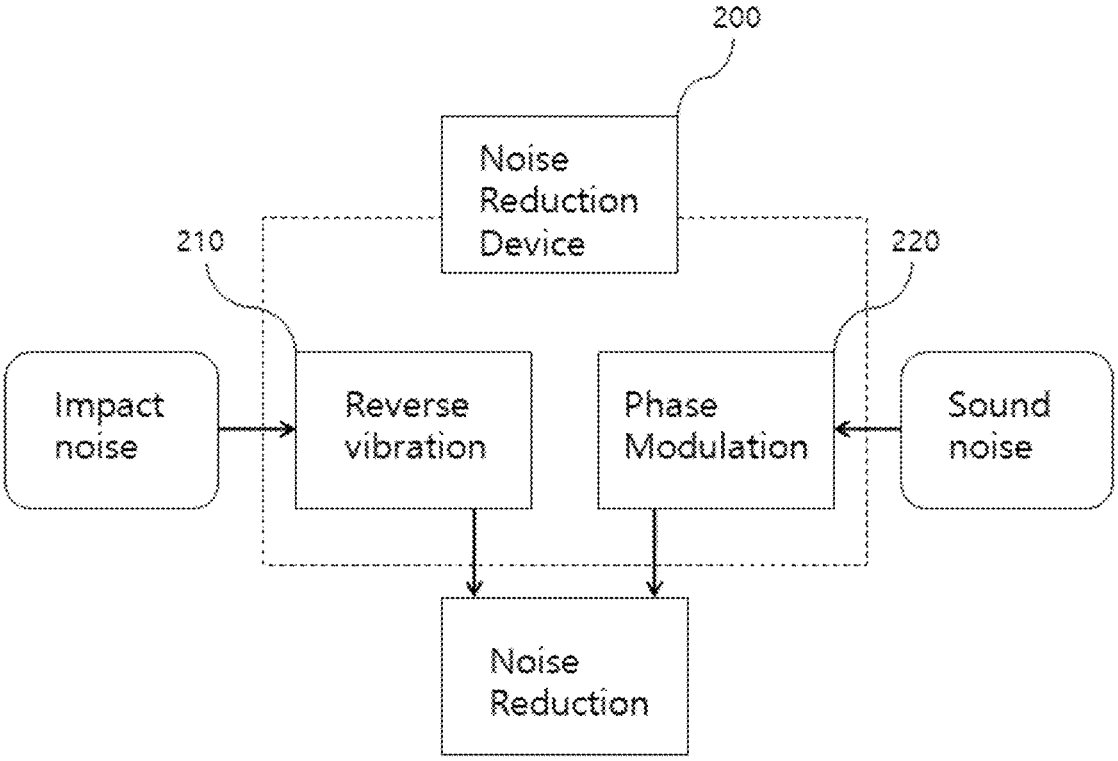
FIG. 3 is a block diagram of the environmental and contextual custom-built AI based, interlayer noise abatement apparatus according to an embodiment of the present disclosure.

FIG. 3 shows a block diagram of the environmental and contextual custom-built artificial intelligence (AI) based, interlayer noise abatement apparatus 1000 of the present disclosure (hereinafter, 'noise abatement apparatus').

As shown in FIG. 3, the noise abatement apparatus 1000 may include the noise detection sensor 100, the noise reduction device 200 and the noise display 300. The noise abatement apparatus 1000 may further include a controller 400 controlling the noise reduction device 200 by using detection information of the noise detection sensor 100 and allowing the detection information to be transmitted to the noise display 300 for the noise display 300 to display the same. The noise abatement apparatus 1000 may further include a noise standard setter 500 setting a noise standard based on a parameter according to an environment and a context, and flexibly delivering, to each household, an intervention level of the noise reduction device and a level of noise severity based on this standard.

In the noise abatement apparatus 1000 having the above configuration, the acoustic noise or the vibration noise may be detected by the noise detection sensor 100, and noise information may be transmitted under control of the controller 400. Here, the controller 400 may analyze a signal of the sensor and determine whether the signal exceeds the standard which may be recognized as the noise. The controller 400 may allow the noise or the vibration to be reduced by operating the noise reduction device 200 when the noise exceeds the above standard. The controller 400 may also allow information of each of the noise-making household to be displayed through the noise display 300 so that the noise-making household may recognize this situation and be induced to voluntarily reduce the noise.

Here, the standard which may be recognized as the noise may be set to noise exceeding 58 dB for light-weight impact sound and noise exceeding 50 dB for heavy-weight impact sound, as mentioned in the background art. However, the standard may be changed based on an environmental factor or a subjective factor of each household. The noise abatement apparatus 1000 of the present disclosure may thus change the noise standard by using the noise standard setter 500.

For example, the noise standard setter 500 may raise or lower the noise standard based on the environmental factor such as daytime, nighttime or weather. Here, raising the noise standard may be defined as loosening the noise standard, and lowering the noise standard may be defined as strengthening the noise standard.

The noise standard may be raised in the daytime, the noise standard may be lower in the nighttime, and a measure even for small noise may thus be performed under the control of the controller 400. In addition, the noise standard may be raised in the season when windows are open, such as summer, and the interlayer noise is thus more likely to be dispersed to the outside, and the noise standard may be lower in the season when the windows are closed, such as winter, and the interlayer noise is thus more likely to be concentrated inside. In addition, a level to which the noise may be detected may be lower by leaving the window open when it is sunny, and the noise standard may thus be raised to reduce the intervention for the interlayer noise reduction under the control of the controller 400; and a level to which the noise may be detected may be raised by closing the window when it is cloudy or raining, and the noise standard may thus be lower to minimize conflict occurring due to the interlayer noise.

In another example, a sensor that detects the opening and closing of the window of each household may be more intuitively applied to lower the noise standard of the corresponding household when the window is open, and raise the noise standard of the corresponding household when the window is closed.

In addition, as an example of a specific time zone, noise sensitivity for each household to the interlayer noise may be lower in a commuting time zone, and the noise standard may be raised in a time zone when the noise is highly likely to occur, thereby reducing an unnecessary noise alarm. In addition, the noise standard may be lower to minimize the conflict occurring due to the interlayer noise when the majority of people reside in the house, such as from 21:00 to 24:00. In another example, a counter sensor that checks the number of people in the corresponding household is positioned more intuitively. In this case, the noise standard may be raised when there are a few people in the corresponding household and the noise sensitivity is thus higher; and the noise standard may be loosen when there are a large number of people in the corresponding household and the noise sensitivity is thus lower.

The noise standard setter 500 may reflect an experimental result of the emotional, psychological or physiological response of the household based on the noise pattern, age or gender of the household as the subjective factor. That is, the noise standard may be lower when a certain noise pattern occurs periodically, and may be lower as the age of the corresponding household is increased. In addition, the noise standard may be lower for women than for men.

In addition, the noise standard may be changed based on the emotional or psychological state of the corresponding household. A person's emotional or psychological state may be changed over time, and the noise sensitivity may be changed based on the person's emotional or psychological state. Therefore, the noise standard setter 500 may monitor this state to change the noise standard. For example, the noise standard setter 500 may include a separate input device for monitoring the emotional or psychological state of a user residing in the corresponding household to monitor the emotional or psychological state of the user for each household. Therefore, the noise standard may be raised when it is monitored that the corresponding household may be psychologically sensitive to the noise, and the noise standard may be lower when it is monitored that the corresponding household may be psychologically insensitive to the noise. The input device may be implemented through a sensitivity manipulator 330 described below.

As described above, the noise standard may be flexibly changed, and it is thus possible to temporarily reduce stress caused by the noise occurring in the noise-making household. It is also possible to increase satisfaction of an interlayer noise victim household due to the reduced noise.

In addition, the noise reduction device 200 may be operated intermittently only when necessary, as a lot of time and money are required for its maintenance. Accordingly, the durability and lifespan of the noise reduction device may be increased to reduce costs for its maintenance. For example, the noise standard may be changed even when the noise or vibration of the same level occurs. Accordingly, it is possible to use the noise reduction device 200 less when the noise does not meet the noise standard to increase the lifespan of the noise reduction device, and to save energy consumed when the noise reduction device 200 is used. In addition, the noise reduction device 200 may be operated when the noise exceeds the noise standard, thereby improving noise reduction efficiency.

In addition, only the second noise reduction device 220 of the noise reduction device 200 may be driven when the noise detected by the noise detection sensor 100 is the acoustic noise, to concentrate on minimizing the indirect transmission noise. On the other hand, the noise reduction through the second noise reduction device 220 may also be expected when the detected noise is the vibration noise. In this case, both the first noise reduction device 210 and the second noise reduction device 220 may be driven to maximize the noise reduction efficiency.

Figure 4:
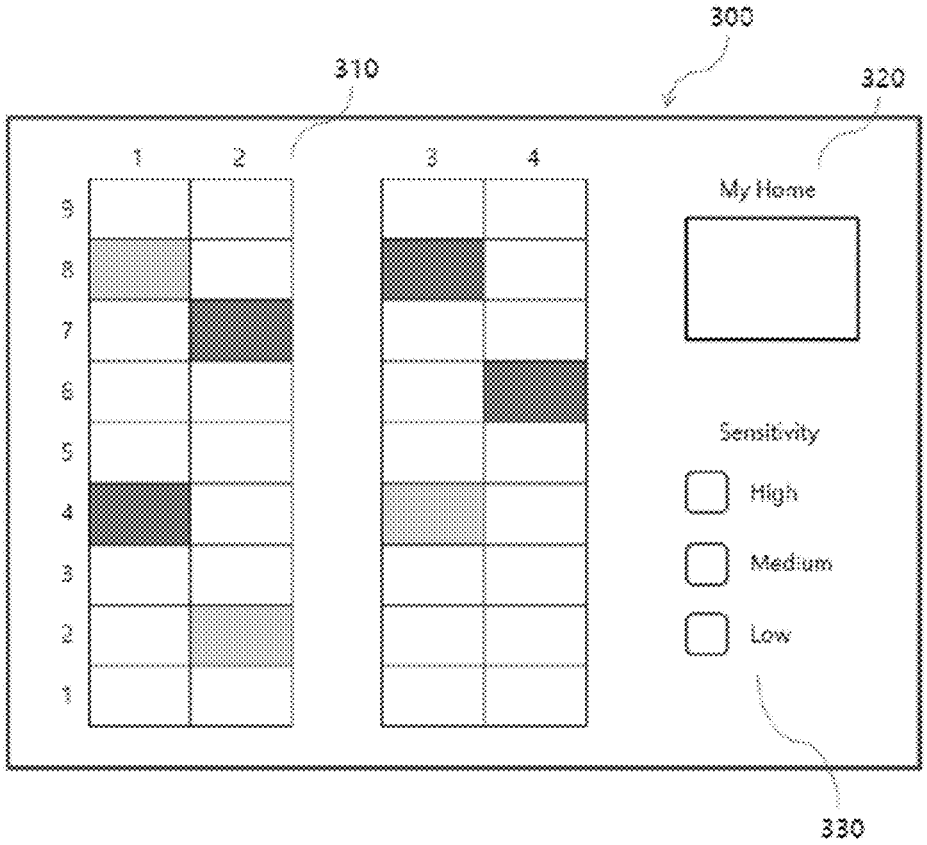
FIG. 4 is a view showing an example of display of a display device of the environmental and contextual custom-built AI based, interlayer noise abatement apparatus according to an embodiment of the present disclosure.

FIG. 4 is a view showing an example of display of the noise display 300 of the environmental and contextual custom-built AI based, interlayer noise abatement apparatus according to an embodiment of the present disclosure. As shown in FIG. 4, the noise display 300 may include a main display 310 displaying the noise intensity for each household, a sub display 320 separately displaying the noise intensity of the corresponding household, and a sensitivity manipulator 330 allowing the corresponding household to manually select the noise sensitivity which may be reflected in the noise standard. The noise display 300 may be applied to an intercom display device generally installed in each household, may be applied to a separate display device only for the noise display, or may assign a channel of a cable TV and perform the noise display through the TV in the corresponding channel.

As shown in FIG. 4, the main display 310 may display the noise information for each household in color for the noise information of all households residing in a multiplex house to be simultaneously checked (with different color illustrated by different levels of shading). That is, the noise information may be obtained by the noise detection sensor positioned in each household. Here, the noise information may be displayed in yellow as a sign of caution when the noise information exceeds the noise standard, and displayed in red as a sign of warning when the noise information exceeds the noise standard for a certain time or more or by a certain width or more to allow the noise-making household to recognize the noise. When displayed in red, the noise information may not only be shown to the corresponding household through the display, but also be alarmed to the corresponding household through the speaker, the announcement or phone call of a management office to forcibly induce the corresponding household to reduce the noise more quickly. In addition, the noise information displayed through the main display 310 may be converted into a database and used as a basis for conflict resolution when interlayer noise conflict occurs between neighbors. As shown in FIG. 4, each noise information of Nos. 401, 702, 803, 604 is displayed in red as the sign of warning that the noise information greatly exceeds the noise standard, and each noise information of Nos. 801, 202, and 403 is displayed in yellow as the sign of caution that the noise information exceeds the noise standard.

Meanwhile, the controller 400 may drive only the second noise reduction device 220 of a neighboring household to concentrate on minimizing the indirect transmission noise when the noise information of the corresponding household is displayed in yellow. Both the first noise reduction device 210 and the second noise reduction device 220 of the neighboring household may be driven when the noise information is displayed in red, thereby maximizing the noise reduction efficiency.

The sub display 320 may display only the noise information of the corresponding household, and it is thus possible to more intuitively determine whether the noise occurs in the corresponding household.

In addition, the noise information of the corresponding household may be linked with a mobile phone of a corresponding household member, and the corresponding household member may monitor the noise information of the corresponding household through an application of the mobile phone. That is, the noise information displayed through the above-described main display 310 may be displayed in the same way through the mobile phone, and the noise information of each household may be displayed in color for the noise information of all the households residing in the multiplex house to be simultaneously checked.

In addition, when the level of the noise occurring in the corresponding household exceeds the noise standard and is displayed in yellow, the level of the noise may be sent as a text message through the mobile phone to forcibly induce the corresponding household member to recognize the noise more quickly and reduce the noise. Further, when the noise is continued even after sending the above text message, or when the level of the noise is displayed in red, the alarm may sound periodically through the mobile phone to forcibly induce the corresponding household member to recognize the noise more quickly and reduce the noise. Furthermore, when the level of the noise occurring in the corresponding household exceeds the noise standard and is displayed in yellow or red, the level of the noise may be alarmed through the intercom of the corresponding household in addition to the mobile phone to forcibly induce the corresponding household to reduce the noise.

In addition, the sensitivity manipulator 330 may manually adjust the noise sensitivity for each household, so that the interlayer noise standard of each household may be raised or lower as needed. For example, the noise standard may be raised by decreasing the noise sensitivity when the corresponding household is away from the house for a few days or for a while, or the noise sensitivity may be increased when the corresponding household needs to lower the noise standard due to telecommuting or studying for a test.

Therefore, the controller 400 may allow the alarm to be displayed to the noise-making household for the noise exceeding 55 dB for example. In this case, the alarm may be displayed for the noise exceeding 50 dB, i.e. less noise, when the noise sensitivity is increased by the user to lower the noise standard, and the alarm may be displayed only for the noise exceeding 60 dB, i.e. louder noise, when the noise sensitivity is decreased by the user to raise the noise standard.

Hereinafter, an abatement method using the above-described abatement apparatus 1000 is described in detail with reference to the drawings.

Figure 5:
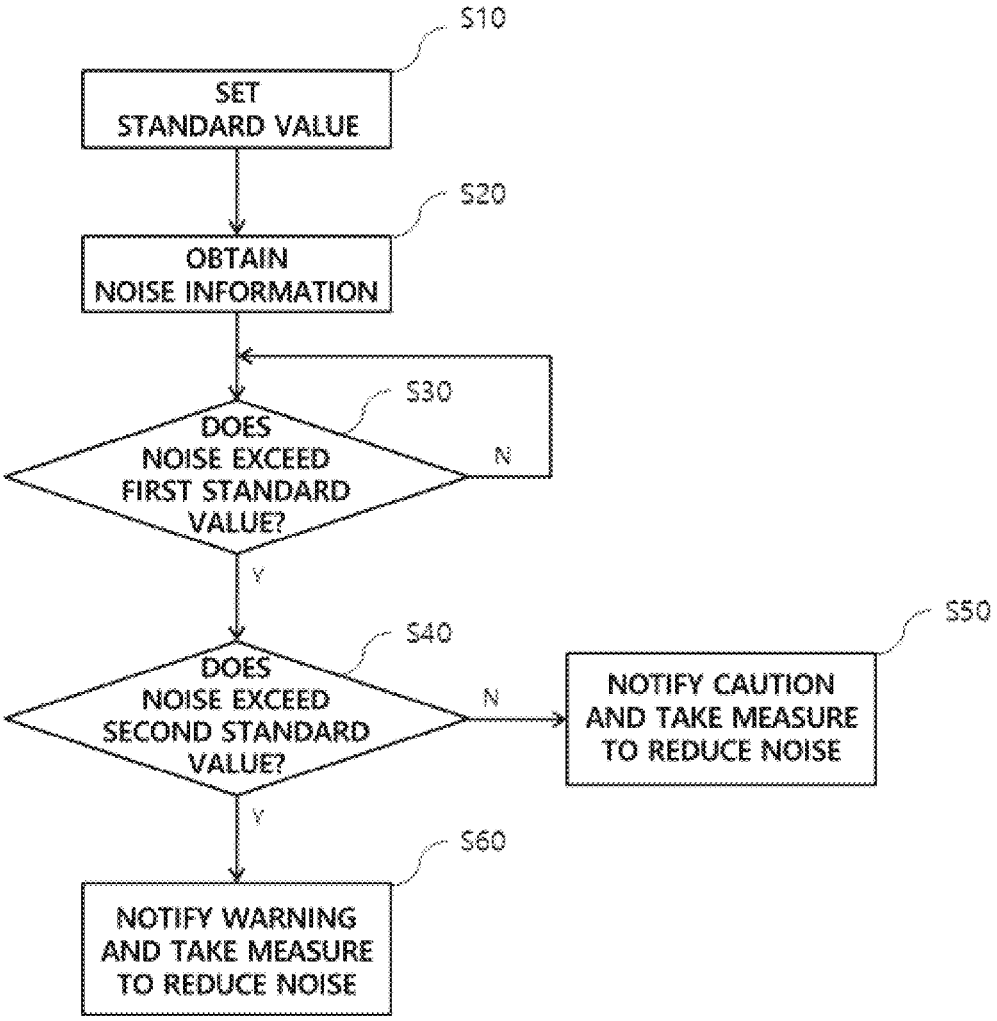
FIG. 5 is a flowchart of an environmental and contextual custom-built artificial intelligence (AI) based, interlayer noise abatement method according to another embodiment of the present disclosure.

FIG. 5 is a flowchart of an environmental and contextual custom-built artificial intelligence (AI) based, interlayer noise abatement method according to another embodiment of the present disclosure.

First performed is an operation S10 of setting a standard value in which the noise standard value is set based on an environment, a context or a manual operation of noise sensitivity. The noise standard value may refer to a standard for alarming a noise-making household and performing a noise reduction measure, under control of a controller. The noise standard value may be raised in a context with low noise sensitivity, and the noise standard value may be lowered in a context with high noise sensitivity. A detailed configuration for application of the noise standard is as described above.

Next, performed is an operation S20 of obtaining noise information in which the noise information of each household may be obtained by the noise detection sensor 100. The noise information may be sound information or vibration information.

Next performed is an operation S30 of determining whether the noise exceeds a first standard value in which intensity of the noise information of each household exceeds the first standard value is determined. The noise standard value may be divided into the first standard value and a second standard value higher by a certain width than the first standard value.

The operation S30 of the determining of whether the noise exceeds the first standard value may be repeatedly performed when the intensity of the noise information is equal to or less than the first standard value, and the operation S30 may proceed to a next operation when the intensity of the noise information exceeds the first standard value.

Next performed is an operation S40 of determining whether the noise exceeds the second standard value in which the intensity of the noise information of each household exceeds the second standard value is determined.

When the intensity of the noise information is equal to or less than the second standard value, a caution may be notified to a noise-making household to induce the corresponding household to voluntarily reduce the noise, and the noise reduction device may be operated to directly reduce the noise(S50).

When the intensity of the noise information exceeds the second standard value, a more strong warning may be notified to the noise-making household to forcibly induce the corresponding household to quickly reduce the noise, and the noise reduction device may be operated to directly reduce the noise(S60).

Figure 6:
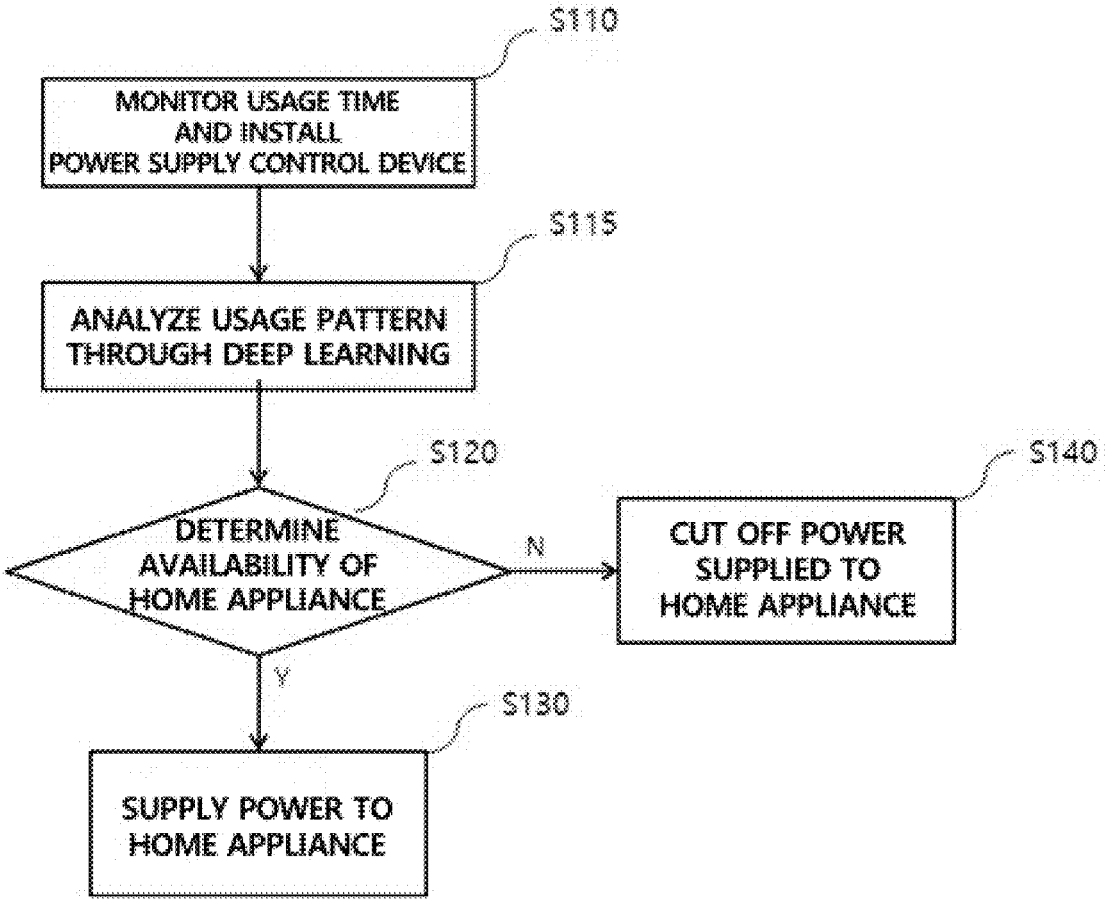
FIG. 6 is a flowchart of another example of the environmental and contextual custom-built AI based, interlayer noise abatement method according to another embodiment of the present disclosure.

FIG. 6 is a flowchart of another example of the environmental and contextual custom-built AI based, interlayer noise abatement method according to another embodiment of the present disclosure.

As an example of a home appliance that causes a lot of vibration or noise, a washing machine, a dishwasher or a vacuum cleaner may cause interlayer noise between households when used at night. Therefore, the environmental and contextual custom-built AI based, interlayer noise abatement method according to another embodiment of the present disclosure proposes the following way to prevent the interlayer noise when the home appliance is used.

First performed is an operation S110 of installing a power supply control device to the home appliance that causes the vibration or noise. The power supply control device may be an electrical outlet to which electricity is supplied or cut off by a control signal from the controller, or a control device attached to each home appliance to maintain or cut off the power supplied to the home appliance by the control signal from the controller.

Next performed is an operation S120 of determining availability of the home appliance in which whether the home appliance is available in the context is determined by the controller. The determination of whether the home appliance is available may be classified based on a time zone. For example, the controller may determine that the home appliance is available in the daytime, and determine that the home appliance is unavailable in the nighttime. As an additional example, before the operation of S120, performed is an operation S110 of monitoring a main usage time zone of the noise-making home appliance for each household, converting the time zone into big data, and analyzing a specific usage pattern for each household through deep learning or the like. Next, in the operation S120 of determining of the availability, it may be determined that the home appliance is available during the main usage time zone for each household that is learned based on the usage pattern, and is unavailable in a time zone other than the main usage time zone. It is also possible to set a function to notify a warning alarm to recommend a user not to use the home appliance as much as possible in the time zone other than the main usage time zone.

As another example, whether the home appliance that causes a lot of vibration or noise is available may be determined by consent of the households residing in a multiplex house. That is, the household that wishes to use the home appliance may send, to the other households, an alarm asking whether it is allowed to use the home appliance. Here, the home appliance may be available only when more than a certain number of the other households consent to its use. As a specific example, the home appliance may be available when 70% or more of all the households consent to its use. Here, when failing to receive a feedback on whether to consent to the use of the home appliance from another household, the controller may identify that another household is absent and determine that the other households consent to its use.

Next, the controller may allow an operation S130 of supplying power to the home appliance to be performed by delivering a control signal indicating that the home appliance is available to the power supply control device when it is determined that the home appliance is available in the operation S120 of determining of the availability, and an operation S140 of cutting off the power supplied to the home appliance to be performed by transmitting a control signal indicating that the home appliance is unavailable to the power supply control device when it is determined that the home appliance is unavailable.

The home appliance that causes a lot of vibration or noise may be available only in the daytime due to the above configuration, and the households residing in the multiplex house may thus have increased satisfaction for the interlayer noise occurring when the home appliance is used in nighttime.

In addition, the home appliance may be available even in the nighttime as long as the other households consent to its use. Therefore, it is possible to reduce disputes or conflicts between the multiplex house residents due to the interlayer noise even when the interlayer noise occurs because the house residents already recognize and allow the noise.

As set forth above, according to the environmental and contextual custom-built AI based, interlayer noise abatement apparatus and method of the present disclosure configured as above, it is possible to improve the interlayer noise reduction efficiency by inducing the interlayer noise maker to recognize whether the interlayer noise occurs and thus fundamentally reduce the interlayer noise.

In addition, it is possible to flexibly change the interlayer noise standard based on the environmental factor such as the daytime or the nighttime, summer or winter, and the context such as the age or sensitivity of the user, allow the interlayer noise-making household to recognize only the noise exceeding the noise standard, thereby improving the satisfaction of the interlayer noise victim due to the reduced noise, and allow stress which may occur to the interlayer noise-making household to be minimized, thereby providing a satisfactory solution of the interlayer noise to both the noise-making household and the noise victim household.

In addition, it is possible to minimize the energy consumption because the lifespan of the noise reduction device is increased by selectively operating the noise reduction device based on the interlayer noise standard.

In addition, the time zone in which the interlayer noise-making home appliance is available may be limited to the daytime, or the home appliance may be available only when the multiplex house residents consent to its use even though the user wishes to use the home appliance in the nighttime. It is thus possible to reduce the disputes or the conflicts between the multiplex house residents due to the interlayer noise because the house residents already recognize or allow the interlayer noise even when the noise occurs.

In addition, it is possible to monitor the main usage time zone of the noise-making home appliance for each household, converting the time zone into the big data, analyzing the specific usage pattern for each household through the deep learning or the like, and notifying the alarm to the neighboring household in advance based on the analyzed pattern, thereby more effectively reducing the disputes or the conflicts between the house residents due to the interlayer noise.

The spirit of the present disclosure should not be limited to the embodiments described above. The present disclosure may be applied to various fields and may be variously modified by those skilled in the art without departing from the scope of the present disclosure claimed in the claims. Therefore, it is obvious to those skilled in the art that these alterations and modifications fall within the scope of the present disclosure.

The invention claimed is:

1. An environmental and contextual custom-built artificial intelligence (AI) based, interlayer noise abatement apparatus, the apparatus comprising:

a plurality of noise detection sensors positioned in each household to measure noise occurring in each household residing in a multiplex house;

a noise display positioned in each household and displaying noise information detected by the noise detection sensor for each household to recognize the noise; and a controller controlling the noise information detected by the noise detection sensor to be received and controlling the noise information to be transmitted to the noise display only when the noise exceeds a certain standard value for the noise information to be displayed through the noise display.

2. The apparatus of claim 1, further comprising a noise reduction device reducing the noise when the noise is detected by the noise detection sensor.

3. The apparatus of claim 2, wherein the controller controls the noise information detected by the noise detection sensor to be received, and controls the noise reduction device to reduce the noise only when the noise exceeds the certain standard value.

4. The apparatus of claim 2, wherein the noise reduction device includes a first noise reduction device installed on the bottom of a floor surface of an upstairs household among the respective households to reduce noise occurring in the upstairs household by using contact reduction vibration, and a second noise reduction device installed on the top of a ceiling surface of a downstairs household among the respective households to reduce the noise occurring in the upstairs household by using non-contact reduction vibration.

5. The apparatus of claim 4, wherein the first noise reduction device reduces heavy-weight noise or direct transmission noise of the upstairs household, and the second noise reduction device reduces light-weight noise or indirect transmission noise of the upstairs household.

6. The apparatus of claim 1, wherein the noise display induces a corresponding household to reduce the noise by displaying the corresponding household in a specific color indicating a caution when the noise exceeds a first standard value which is the certain standard value, and forcibly induces the corresponding household to reduce the noise by displaying the corresponding household in another specific color indicating a warning when the noise exceeds a second standard value which is higher by a certain width than the first standard value.

7. The apparatus of claim 1, further comprising a noise standard setter delivering noise standard information to the controller for a noise standard to be set based on a parameter for each environment or context.

8. The apparatus of claim 2, wherein the controller controls the noise information detected by the noise detection sensor to be received, and controls the noise to be reduced by the noise reduction device only when the noise exceeds the certain standard value.

9. The apparatus of claim 1, wherein the noise display includes a main display displaying noise intensity for each household;

a sub display separately displaying the noise intensity of a household in which the noise display is installed; and a sensitivity manipulator allowing a corresponding household to manually select noise sensitivity.

10. The apparatus of claim 1, wherein the noise display is applied to an intercom installed in each household, a separate display device or a television (TV) by assigning a channel of a cable TV.

11. The apparatus of claim 6, wherein when the warning for the corresponding household is displayed, the controller allows the corresponding household to be alarmed through a speaker or by the announcement or phone call of a management office to forcibly induce the corresponding household to reduce the noise.

12. An environmental and contextual custom-built artificial intelligence (AI) based, interlayer noise abatement method, the method comprising:

an operation of setting a standard value in which the noise standard value is set based on an environment, a context or a manual operation of noise sensitivity;

an operation of obtaining noise information in which the noise information of each household is obtained by a noise detection sensor;

an operation of determining whether intensity of the noise information of each household exceeds a first standard value;

an operation of repeating the operation of the determining when the intensity of the noise information is equal to or less than the first standard value, and proceeding to a next operation when the intensity of the noise information exceeds the first standard value;

an operation of determining whether the intensity of the noise information of each household exceeds a second standard value; and an operation of notifying a caution to a corresponding noise-making household when the intensity of the noise information is equal to or less than the second standard value, or notifying a warning to the corresponding noise-making household when the intensity of the noise information exceeds the second standard value.

* * * * *